US006120416A

United States Patent [19]

Walker

[11] Patent Number: 6,120,416

[45] Date of Patent: Sep. 19, 2000

[54] ISOMETRIC ARM AND LEG EXERCISER

[75] Inventor: Don F. Walker, 1001 W. Stevens, #196, Santa Ana, Calif. 92707

[73] Assignee: Don F. Walker, Santa Ana, Calif.

[21] Appl. No.: 08/930,463

[22] PCT Filed: Aug. 12, 1996

[86] PCT No.: PCT/US96/13140

§ 371 Date: Sep. 24, 1997

§ 102(e) Date: Sep. 24, 1997

[87] PCT Pub. No.: WO97/06859

PCT Pub. Date: Feb. 27, 1997

Related U.S. Application Data

[63] Continuation-in-part of application No. 08/514,111, Aug. 11, 1995, abandoned.

[51] Int. Cl.[7] ..... A63B 69/16

[52] U.S. Cl. ..... 482/57; 482/52; 482/51

[58] Field of Search ..... 482/55, 56, 142, 482/130, 52, 110, 907, 57; 128/25

[56] References Cited

U.S. PATENT DOCUMENTS

| | | | |
|---|---|---|---|
| 3,759,511 | 9/1973 | Zinkin et al. . | |
| 4,247,098 | 1/1981 | Brentham . | |
| 4,634,127 | 1/1987 | Rockwell . | |
| 4,722,525 | 2/1988 | Brentham . | |
| 4,986,261 | 1/1991 | Iams et al. | 128/25 |
| 5,273,508 | 12/1993 | Jones . | |
| 5,300,005 | 4/1994 | Wang . | |
| 5,356,356 | 10/1994 | Hildebrandt et al. | 482/62 |
| 5,387,171 | 2/1995 | Casey et al. . | |
| 5,419,747 | 5/1995 | Piaget et al. . | |
| 5,445,583 | 8/1995 | Habing | 482/52 |
| 5,462,509 | 10/1995 | Lister . | |
| 5,486,150 | 1/1996 | Randolph . | |
| 5,518,479 | 5/1996 | Young et al. . | |
| 5,704,633 | 1/1998 | Sokol | 482/62 |
| 5,743,832 | 4/1998 | Sand et al. | 482/52 |

*Primary Examiner*—Jerome Donnelly
*Attorney, Agent, or Firm*—Knobbe, Martens, Olson & Bear LLP

[57] ABSTRACT

The invention is an exercise machine (20) for exercising many major muscle groups in the body without stressing the arm or knee joints. An inclined bench (24) mounts rigidly within a frame (22) and in specific relationship to a pair of horizontal axes about which a pair of arm levers (40) and a pair of leg levers (60) pivot, respectively. The arm pivot is located with respect to the bench at the user's shoulder joint, while the leg pivot is located with respect to the bench at the user's hip joint. The rotation of the arm and leg levers (40, 60) may be independent, or may be coupled. The rotation of the arm and leg levers are subject to a torque resistance applied by springs, cables and dead weights, frictional resisted loads, or viscous damping. In one embodiment, the rotation of the arm and leg levers are coupled via a linkage mechanism which drives a locomotive style crank for rotating a flywheel. The flywheel is subject to a braking force by an adjustable means to vary the amount of torque resistance applied to the arm and leg levers.

17 Claims, 9 Drawing Sheets

ISOMETRIC ARM AND LEG EXERCISER

This Application is CIP of Ser. No. 08/514111 filed Aug. 11, 1995 now abandoned.

BACKGROUND OF THE INVENTION

1. Field of the Invention

The present invention relates to exercise equipment which provides an effective workout without stressing the knee or elbow joints and, more specifically, to an exercise machine which supports the weight of the user and isometrically exercises the arms and legs with minimal extension or flexion of the knee and elbow joints during the workout.

2. Description of the Related Art

Maintaining proper fitness is a growing concern for many Americans. In the past few decades, medical science has become increasingly aware of the value of exercise to the overall health of an individual. As a direct result, many individuals have committed to a routine of regular exercise and proper eating habits. Unfortunately, today's busy lifestyles have made it difficult to find the amount of time necessary to devote to a proper full body workout. As a result, many people have only a limited period before or after work to exercise in a gym. Also, many prefer to maintain home exercise equipment, which provides the flexibility of working out whenever their schedule allows. Simultaneously, there is a demand for exercise equipment for the home and gym which is compact, yet which also is capable of exercising most of the major muscle groups.

As more individuals exercise and maintain a more active lifestyle, the number of injuries has also increased dramatically. Among the most common injuries are aggravation of the knee joint, back strains and to a lesser extent injuries to the elbow joint. Ironically, these injuries occur when an individual is exercising to attain a more healthy lifestyle. Many knee and elbow injuries occur on exercise machines which are designed in a manner which places undue stress on the knee and elbow joints during operation. Thus, there has been an increased interest in exercise equipment which reduces the impact to the knee and elbow joints. Additionally, the knee and elbow joints endure extreme amounts of stress during active sports such as tennis, skiing, jogging, baseball, and racquetball. If a person has suffered a knee or elbow injury playing such active sports, their range of motion may be limited, and that individual's exercise program must be modified to avoid subjecting the injured joint to additional stress. Even after full rehabilitation, it is desirable to avoid unnecessary stress on the arm and knee joints during exercise. Thus, exercise machines which cater to the debilitated or recuperating athlete are in demand.

Exercise machines in the prior art, which are capable of providing a full body workout, often cause undue stress to the arm and leg joints. Most machines are developed to isolate a specific muscle or muscle group without regard to other muscles or joints in the body. As a result, many people inadvertently exert undue stress on muscles and joints while exercising other parts of the body.

SUMMARY OF THE INVENTION

The present invention provides a device designed to exercise the major muscle groups of the body while minimizing stress on the knee and elbow joints. In one embodiment of the invention, an exercise machine that is sufficiently compact and lightweight to allow for use in both the home and gym, provides the resistance required to exercise a wide variety of muscle groups without stressing the vulnerable knee and elbow joints, and back muscles. The machine is designed for a user to sit in a stationary seat while his or her arms and legs engage pivoting levers. The levers are subject to constant or variable resistance to pivoting depending on the desire or capability of the user. Each of the four levers may be independently movable, or may be coupled to the movement of one or more other levers. Typically, the right arm and leg levers are couple together, as are the left arm and leg levers. To reduce impact to the knee joints, the leg levers pivot about an axis approximately in line with the hip joint of the user. Likewise, to reduce impact on the elbow joint, the arm levers pivot about an axis approximately in line with the shoulder joint of the user. The locations of the pivot axes of the arm and leg levers are determined based on an average human ergonomic model.

In a preferred embodiment of the present invention, a support frame holds a bench that supports the weight of the user at an angle to the horizontal. A pair of arm levers are mounted to pivot about the frame along a common axis which approximates the axis of rotation of an average user's shoulder relate to the position of the bench. Likewise, a pair of leg levers are mounted to rotate about the frame along a common axis which approximates the average user's hip joint. The pivoting movement of each of the arm and leg levers is resisted using a constant or varying torque resistance means.

DESCRIPTION OF THE PREFERRED EMBODIMENTS

Figure 2:
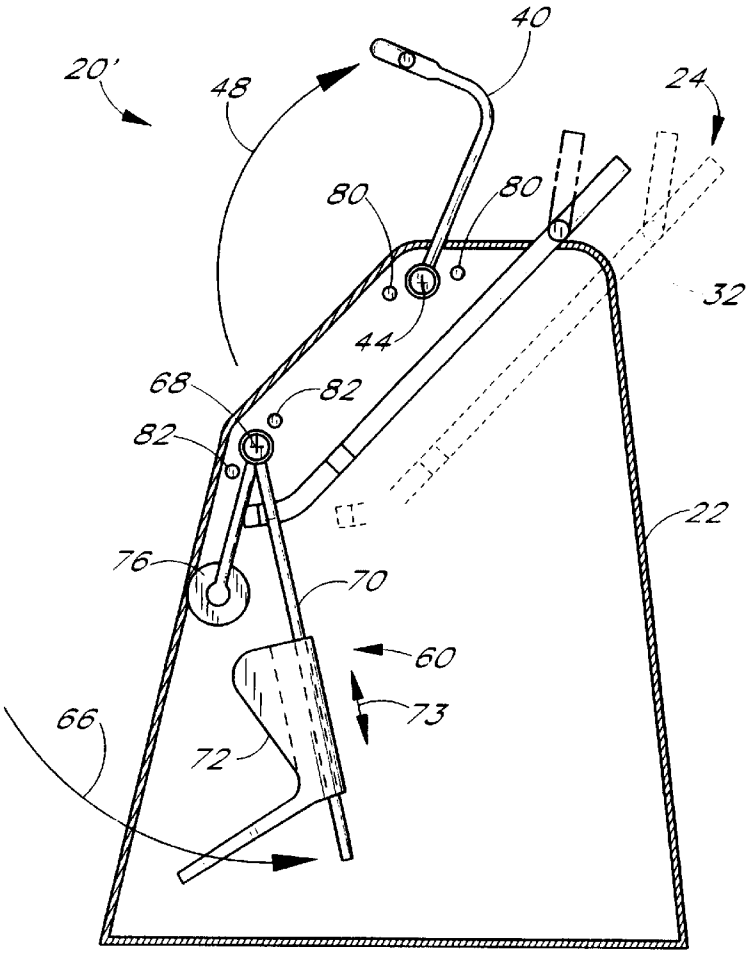
FIG. 2 is a side elevational schematic view of an exercise machine of the present invention similar to that shown in FIG. 1 having position adjustments for a support bench and for the arm and leg levers.
Figure 1:
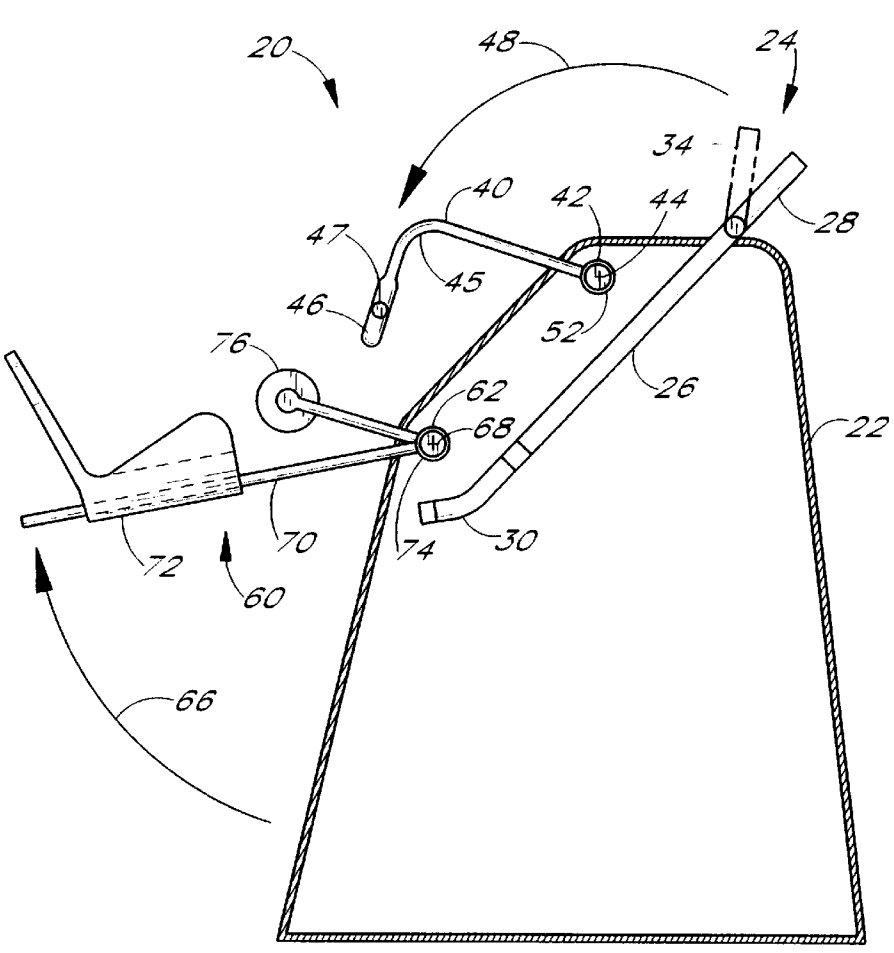
FIG. 1 is a side elevational schematic view of one embodiment of the exercise machine of the present invention having independently movable arm and leg levers.

A first embodiment of an exercise machine 20 of the present invention is illustrated in side elevational view in FIGS. 1 and 2, and in several front elevational views in FIGS. 3–6. The exercise machine 20 comprises a rigid frame 22 shown in outline only. The frame 22 is constructed of any sufficiently strong material, such as a lightweight metal or composite material to support the various load bearing and moving elements of the present invention. More particularly, the present exercise machine 20 is designed to support a human being, and as such, the frame 22 must be sufficiently strong. Concurrently, the exercise machine is designed for home use, as well as commercial use, and is preferably made as lightweight as possible to allow for ease of transport. Retractable or locking wheels (not shown) may be provided to facilitate transport of the machine 20. In addition to the particular shapes shown in the figures, the frame 22 of the present invention may assume a variety of styles and shapes, and still fit within the scope of the invention.

A bench 24 is rigidly mounted on the frame 22 at an angle. The bench 24 is designed to support the weight of a user, and as such preferably includes a flat, rigid inner board having a soft foam rubber or other such padding covered by vinyl or other such non-absorbent material. The bench 24 comprises a back support 26, an upper headrest 28, and a lower curved portion or seat 30. The headrest 28 is designed to be tilted over a range of positions to accommodate different heights and physical features of various users. This adjustability is shown by the dashed line position 34. The seat 30 curves upward from the plane of the back support 26 to prevent the user from sliding off the bench 24. Although the seat 30 is shown as a curved portion, it may also be formed as a 90° extension of the back support 26, or other more sophisticated shapes designed to closely conform to the body of the user. The back support 26 is inclined from the horizontal to provide greater leverage to the user when exercising his or her legs, as will become more apparent below. In the preferred embodiment, the bench 24 is permanently inclined at approximately a 45° angle from horizontal, although this angle may vary from between 30° to 90°. Alternatively, as seen in an adjustable version 20' of the exercise machine shown in FIG. 2, the angular inclination or horizontal position of the bench 24 may be adjusted in a number of ways not shown, as indicated by the dashed outline 32.

A significant feature of exercise machines constructed in accordance with the preferred embodiment of the present invention involves conditioning of the user's arm muscles without significant flexure or extension of the elbow joint. That is, the arms and legs of the user are exercised isometrically. Isometric exercise, by definition, involves muscular contraction which occurs when the ends of the muscle are fixed in place so that the muscles are placed in tension without appreciable decrease in length. In exercise machines of the present invention, the arms and legs of the user are maintained in a slightly bent posture as they follow the arc of rotation about the shoulder and hip joints. A torque resistance is provided so that the arms and legs are placed in tension during their rotation, but the muscles in the arms and legs are not increased or decreased in length appreciably. The muscles of the hips and shoulders, are desirably exercised isotonically whereby the stress imposed on these muscle groups remains essentially constant regardless of the speed of the arm and leg lever rotation, while the stomach and back muscles are worked isometrically and stabilize the torso. In some instances, such as for rehabilitating injuries, an isokinetic muscle workout is preferred in which the stress applied varies even as the speed of rotation of the arm and leg levers remains constant. As will be appreciated by professional fitness trainers, the present invention may be customized to accommodate a variety of user needs. In all configurations, however, the back muscles are exercised without experiencing compressive stresses normally associated with lifting actions. This greatly reduces the chance of back strains and other such painful mishaps.

As seen in FIGS. 1 and 2, the exercise machine 20 (20') further includes an arm lever 40 mounted to the frame 22 at an arm pivot 42, to allow rotation about an arm axis 44. The arm lever 40 is shown as an angled barlike member having a 90° turn 45 leading to a primary hand grip 46. A secondary hand grip 47 extends perpendicularly from the primary hand grip 46. A user may grip the primary hand grip 46 or the horizontally disposed secondary hand grip 47 as desired. Of course, other variations of arm levers and hand grips are contemplated, such as that shown with respect to the embodiment of FIGS. 9–11.

The arm lever 40 rotates about the frame along a rotational arc 48. FIG. 1 illustrates the arm lever 40 rotting in a counter-clockwise or downward direction along the arc 48, while FIG. 2 illustrates the arm lever rotating in a clockwise or upward direction along the arc. FIGS. 3–6 illustrate a right arm lever 40*a* and a left arm lever 40*b* (as viewed from the perspective of a user seated on the bench 24). The right arm lever 40*a* rotates on a suitable bearing about a shaft stub 50*a* mounted in the frame 22, and the left arm lever 40*b* rotates on a suitable bearing about a shaft stub 50*b* mounted in the frame. An arm torque resistor 52 is schematically shown in FIGS. 1 and 2 and is coupled to the movement of the arm lever 40 to resist its rotation in either direction. In this respect, the arm torque resister 52 may be a single or double coil spring or various other means of applying a resistive torque to rotation of the arm lever 40.

Figure 4:
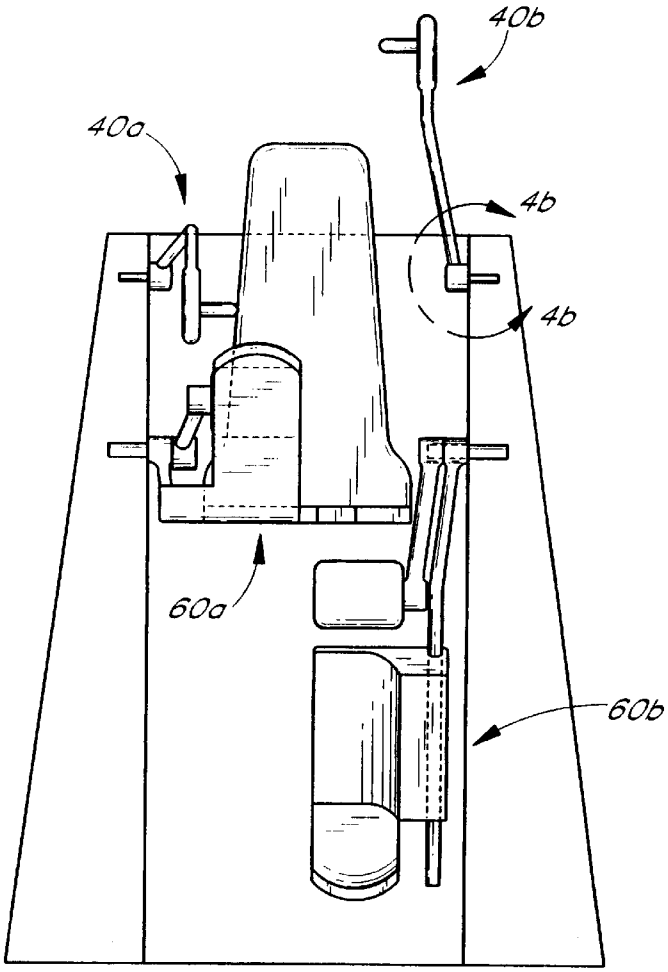
FIGS. 3 and 4 are front elevational views of the exercise machine in FIG. 1 illustrating coupled rotation of the arm and leg levers on each side of the machine, the rotation of the levers on one side being out of phase with that of the levers on the other side.
Figure 4B:
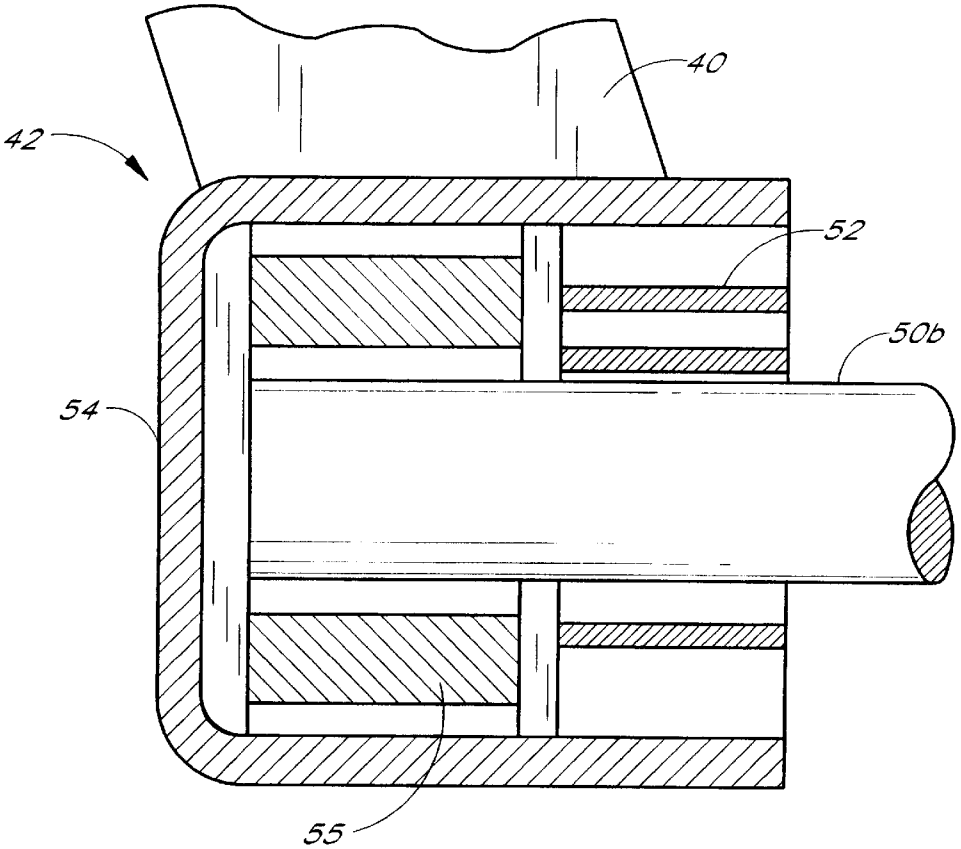
FIG. 4*b* is a detailed cross-sectional view of one embodiment of an arm lever mount and arm torque resistor taken about the circle 4*b*—4*b* of FIG. 4.
Figure 4A:
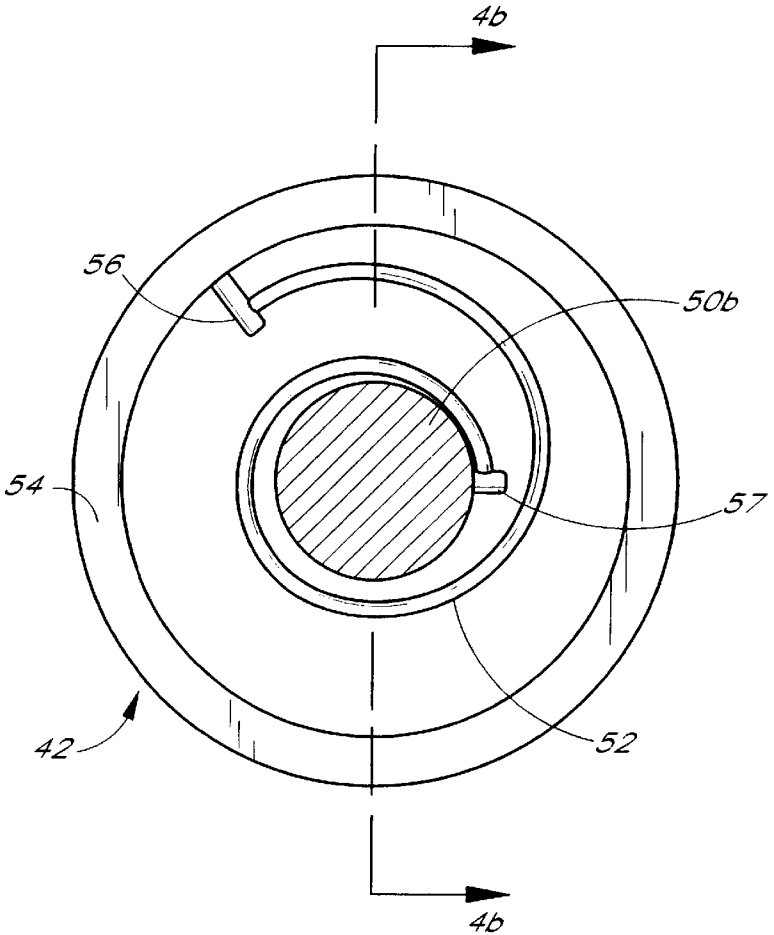
FIG. 4*a* is a cross-sectional view of one embodiment of an arm torque resistor taken along line 4*a*—4*a* of FIG. 4*b;*

FIGS. 4*a* and 4*b* illustrate the torque resistor 52 as a coil spring. Specifically, the lever arm 40 terminates in a cup-shaped housing 54 adapted to receive the outer races of a bearing 55. The inner bearing races are supported on the shaft stub 50*b*. In this manner, the lever arm 40 rotates freely about the fixed shaft stub 50*b*. A member 56 projecting inwardly from the housing 54 attaches to one end of the coil spring 52, while a member 57 projecting outwardly from the shaft stub 50*b* attaches to the opposite end of the spring. As seen in FIG. 4*a*, rotation of the housing (and coupled lever arm 40) in a counterclockwise direction with respect to the fixed shaft 50*b* places the spring 52 in increased tension, which in turn produces a resistance to further rotation. The spring constant may be customized to provide a number of exercise levels. In an alternative embodiment, the shaft stub 50*b* may be rotationally adjusted into several locked positions within its frame mount to preset various tensions in the spring 52.

As mentioned above, the present exercise machine 20 provides an arm exercise which significantly reduces the amount of flexure or extension of the elbow joints In this respect, the axis 44 of arm lever rotation is located with respect to the bench 24, and seat 30, so as to be approximately in line with a shoulder joint of an average user. That is, various ergonomic models are available to predict the average human height and shape. These data are used to predict an average location of the shoulder joint, and the axis 44 is positioned in the frame 22 with respect to the bench 24 accordingly. The distance from the arm axis 44 to the hand grips 46 or 47 is preferably shorter than the average distance from a shoulder joint to the hand of the user, and thus the user's arm is slightly bent when resting on the bench 24 and gripping the arm lever 40. This bent posture of the arm is maintained throughout the rotational arc 48 of the arm lever 40 so as to minimize any changes in angle between the forearm and the upper arm, thus essentially eliminating movement at the elbow. This preferred posture advantageously exercises the muscles in the chest, shoulder and back area, while the user's arm muscles are exercised isometrically.

Another significant feature of exercise machines constructed in accordance with the preferred embodiment of the invention is that the user's knee joint is not dynamically flexed or extended throughout the exercise. Referring again to FIGS. 1–6, a leg lever 60 is mounted at a leg pivot 62 to rotate about a fixed horizontal axis 68 relative to the frame 22. As seen in FIGS. 3–6, a right leg lever 60*a* rotates on a suitable bearing about a shaft stub 64*a* mounted in the frame 22. Likewise, a left leg lever 60*b* rotates on a suitable bearing about a shaft stub 64*b* mounted in the frame 22. The following description references only one side of the exercise machine, with the same description applicable to both sides as the machine is symmetric about a central plane.

The leg lever 60 rotates in both directions along an arc 66 about the axis 68, and comprises an elongated bar 70 having an adjustable foot rest 72 thereon. The foot rest 72 may be adjusted longitudinally along the bar 72 as seen by directional arrow 73 in FIG. 2 to change the distance between the foot rest and the axis of rotation 68. This is to accommodate different leg sizes of various users. In a similar manner as the arm torque resistor 52, a leg torque resistor 74 is provided to apply resistive torque to rotational movement of the leg lever 60. A leg torque resistor may be one or more coil springs, or other such device. Because the muscles in the leg area can transfer a larger force to the leg lever 60 than the arm can to the arm lever 40, the leg torque resistor 74 may be scaled to provide a larger amount of torque resistance to movement of the leg lever, than the arm torque resistor 52 does for the arm lever 40. A knee rest 76 is preferably provided at a midway point between the leg pivot 62 and the foot rest 72 to provide a support to the inner knee region of the user. That is, a preferred posture of the user's leg has the knee slightly bent and resting on the knee rest 76 and the foot in contact with the foot rest 72. A strap (not shown) may be used to secure the user's foot in the foot rest 72. As is well known in the art, a strap over the user's foot enables the user to apply torque to the leg lever 60 in both directions along the rotational arc 66.

An important feature of the present invention, as mentioned above, is the exercise of the user's leg without significantly flexing or contracting the knee. That is, the leg lever 60 is adapted to rotate about the axis 68 which is desirably positioned approximately in line with the user's hip joint. Again, from ergonomic models, the average position of the leg axis 68 with respect to the bench 24 is determined. This preferred posture of the user's leg rotating with the leg lever 60 advantageously exercises muscles in the hip, chest and abdomen area, while the user's leg muscles are exercised isometrically.

The arm lever 40 and leg lever 60 preferably rotate about fixed axes 42 and 68, respectively, in the frame 22. Again, these axes 42, 68, are located based on an average human model. Of course, a manufacturer could provide a number of different positions of the leg lever 40 and arm lever 60 with respect to the bench 24 for different sizes of users. For example, in one embodiment, separate exercise machines 20 for average persons of small stature, for average persons of medium stature, and for average persons of large stature may be made available. Likewise, as the human anatomy greatly varies from individual to individual, these axes may be adjustable. As seen in FIG. 2, a pair of arm pivot adjustment holes 80 are shown for modifying the location of the arm pivot 42. When necessary, the arm lever 40 may be repositioned in one of the holes 80 to adjust for a particular user. Of course, while there are only two adjustment holes 80 are shown, any number of adjustment holes, or other means of relocating the arm axis 44, are contemplated. In a like manner, a pair of adjustment holes 82 may be provided above and below the mounting hole for the leg pivot 62. Thus, both the arm lever 40 and the leg lever 60 may be relocated based on the user's size. Because of the large forces exerted on the exercise machine 20, the bearings for rotatably mounting the arm and leg levers 40 and 60 are preferably relatively rugged. Therefore, the adjustment of the positions of the arm levers 40 and leg levers 60 will desirably be done by the manufacturer. Alternatively, the manufacturer might provide the frame 22 having the adjustment holes 80 and 82, and provide the arm levers 40 and leg levers 60 separately for the distributor or retailer to professionally install based on customer demand. This allows for a standard model to be produced by the manufacturer with the various sizes being configured later for flexibility in retailing.

In the embodiments of FIGS. 1 and 2, the arm lever 40 and leg lever 60 are illustrated as being mounted for independent rotation about the frame 22. Although independent rotation is possible, and may indeed be preferable in some situations, a more common method of operating the exercise machine 20 involves coupled movement of the arm and leg levers 40 and 60 on each side of the machine. In addition, the arm and leg levers on both sides may be in phase or out of phase. These different situations are illustrated in FIGS. 3–6.

Figure 3:
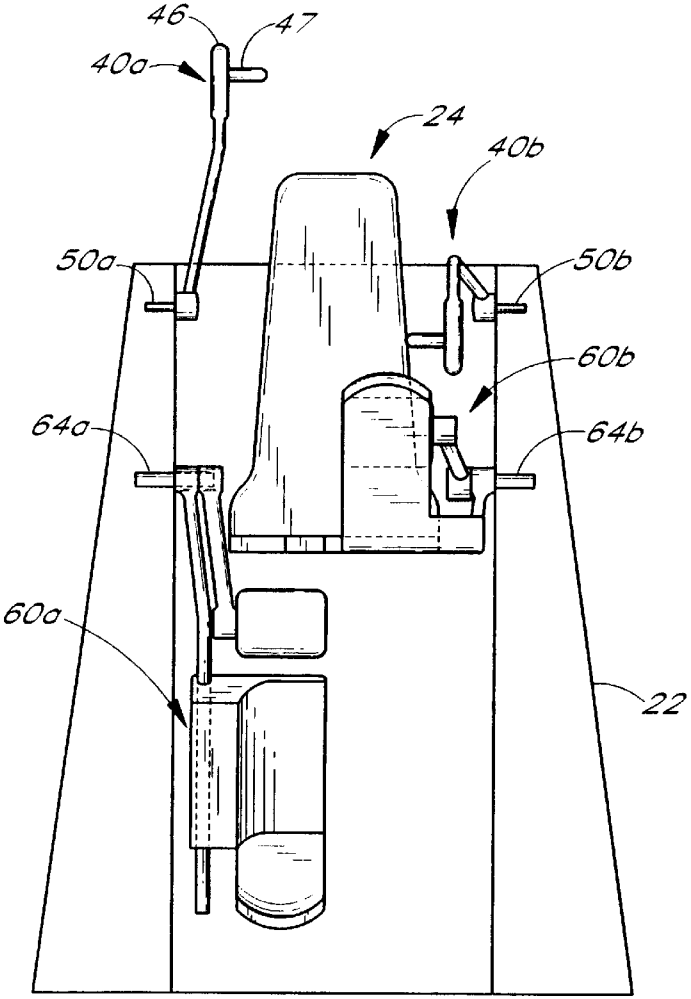

In FIGS. 3 and 4, the arm levers 40*a* and 40*b* are illustrated as being rotationally out of phase. Likewise, the leg lever 60*a* and 60*b* are out of phase. However, the rotation of the arm lever 40*a* and the leg lever 60*a* are coupled so that when the arm lever 40*a* is raised up, the leg lever 60*a* is in a downward position. This is seen on the left half of FIG. 3 from the perspective of the reader. In the right half of FIG. 3, the arm lever 40*b* is illustrated in a down position, with the leg lever 60*b* illustrated in a raised position. FIG. 4 illustrates the opposite position of the arm and leg levers.

Figure 6:
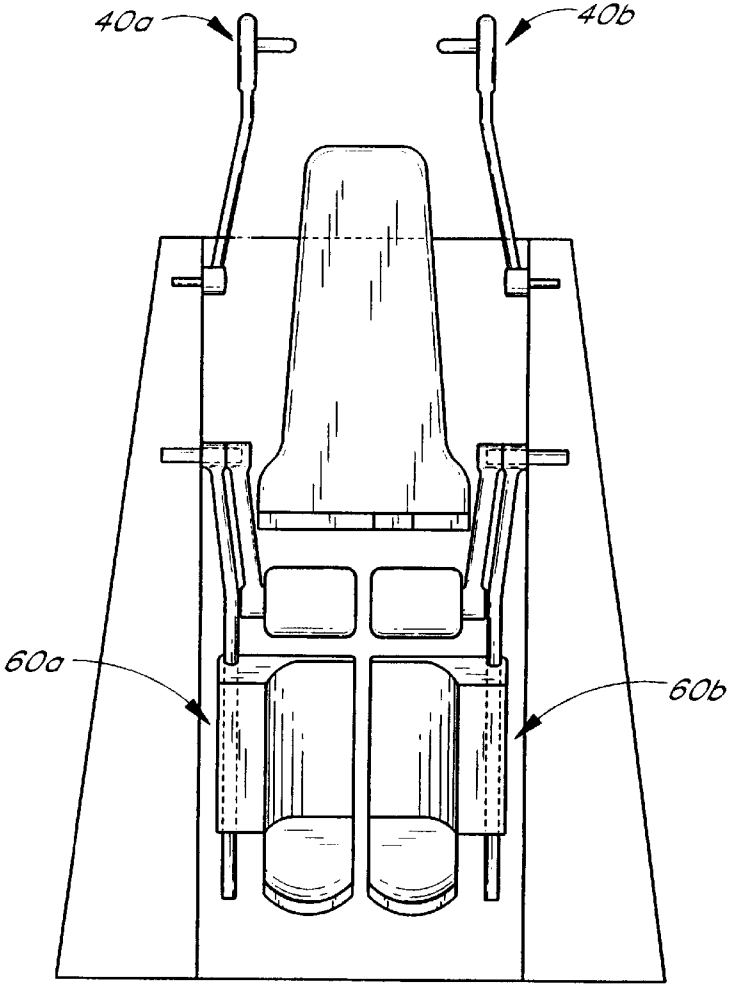
FIGS. 5 and 6 are front elevational views of the exercise machine in FIG. 1 illustrating coupled rotation of the arm and leg levers one each side of the machine, the rotation of the levers on one side being in phase with that of the levers on the other side.
Figure 5:
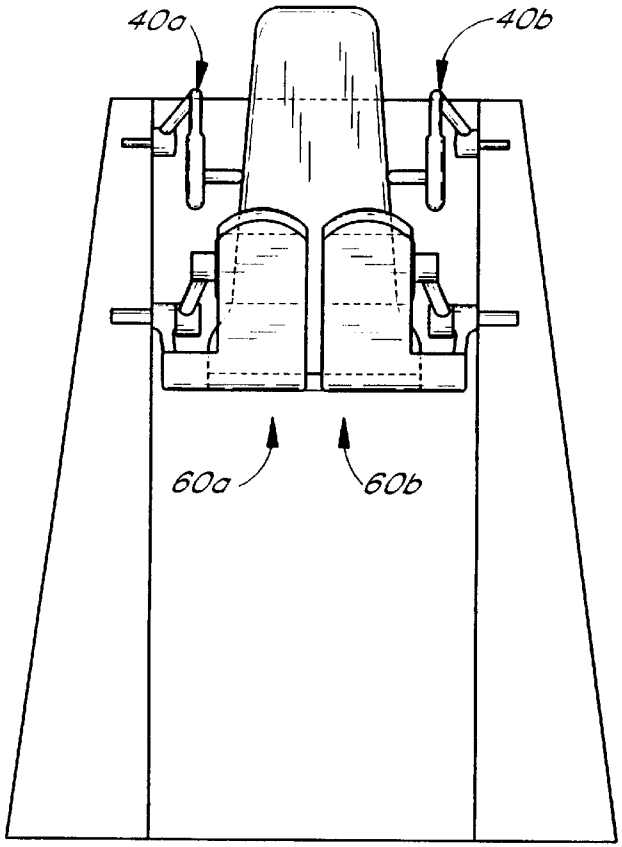

In FIGS. 5 and 6, the arm and leg levers on each side operate in tandem and the rotation of the arm and leg levers on both sides are in phase. That is, FIG. 5 illustrates both arm levers 40*a* and 40*b* in lowered positions and both leg levers 60*a* and 60*b* in raised positions. Conversely, in FIG. 6 the arm levers 40*a* and 40*b* are raised, while the leg levers 60*a* and 60*b* are lowered. It will be appreciated by one of skill in the art that the orientation of the arm and leg levers may be adjusted to enable in phase or out of phase rotation.

Figure 7:
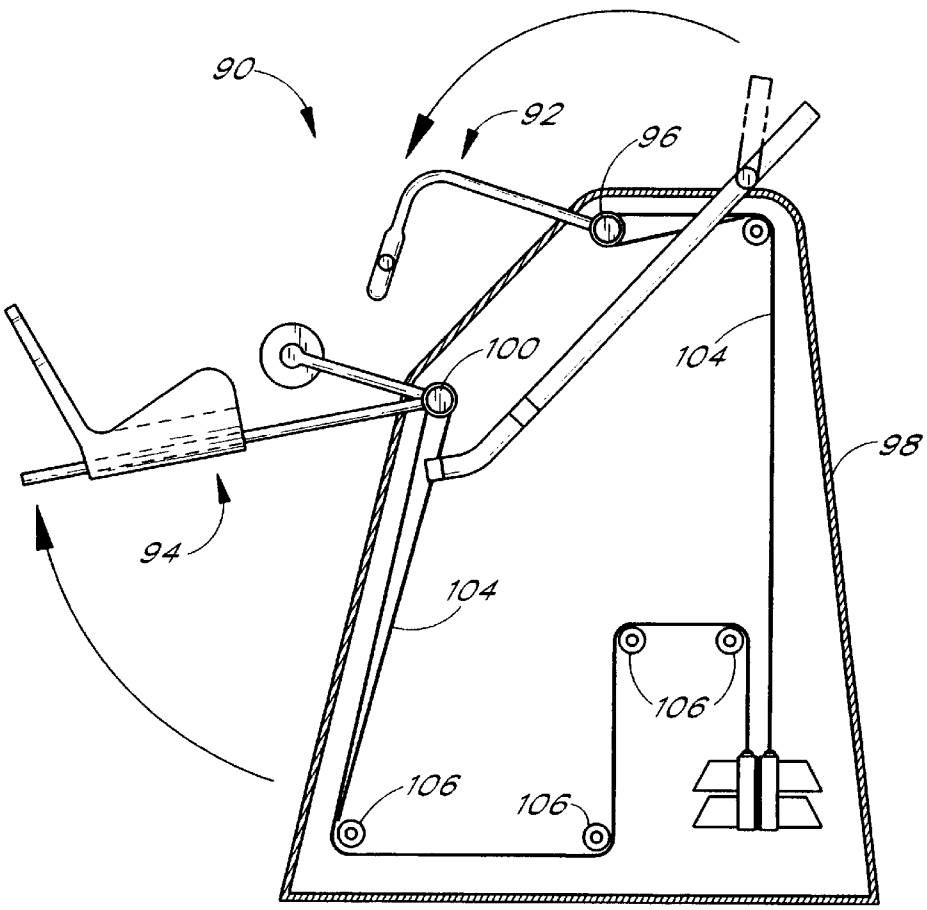
FIG. 7 is a side elevational view of an exercise machine illustrating a cable and pulley mechanism for coupling the rotation of the arm and leg lever on one side of the machine, and including a dead weight torque resistance system.

FIG. 7 illustrates an alternative exercise machine 90 in which the rotation of an arm lever 92 and a leg lever 94 are coupled. The arm lever is mounted to rotate about a pivot 96 mounted in a frame 98, and the leg lever 94 is adapted to rotate about a pivot 100. Again, the pivots 96 and 100 are located at the average location of a user's shoulder joint and hip joint, respectively. The pivots 96 and 100 are coupled to a pair of cables 104, or a single continuous cable, looped around a plurality of pulleys 106 mounted for rotation in the frame 98. The cables 104 are attached to a resistive or gravitational load, such as shown by the dead weights 108. The cables 104, pulleys 106 and weights 108 may be configured to apply a torque to the rotation of the arm lever 92 and leg lever 94 in one direction only, or may comprise a dual system in which the rotations of the arm and leg levers are resisted in both directions. The specific assembly is shown schematically, and a number of variations will be apparent to one of skill in the art. In one typical example, rotation of the arm levers 92 upward lifts the weights 108 thus applying a force against the arm lever rotation. Conversely, lowering the arm levers 92 lowers the weights, and thus the user must maintain an upward force to prevent the assembly from slamming down. The type of force applied by the dead weights 108 is constant, and thus the resistance to rotation experienced by the arm and leg levers 92 and 94 is a constant throughout the range of motion. Of course other force applying means may be used which result in a non-linear application of torque to the arm and leg levers.

Figure 8:
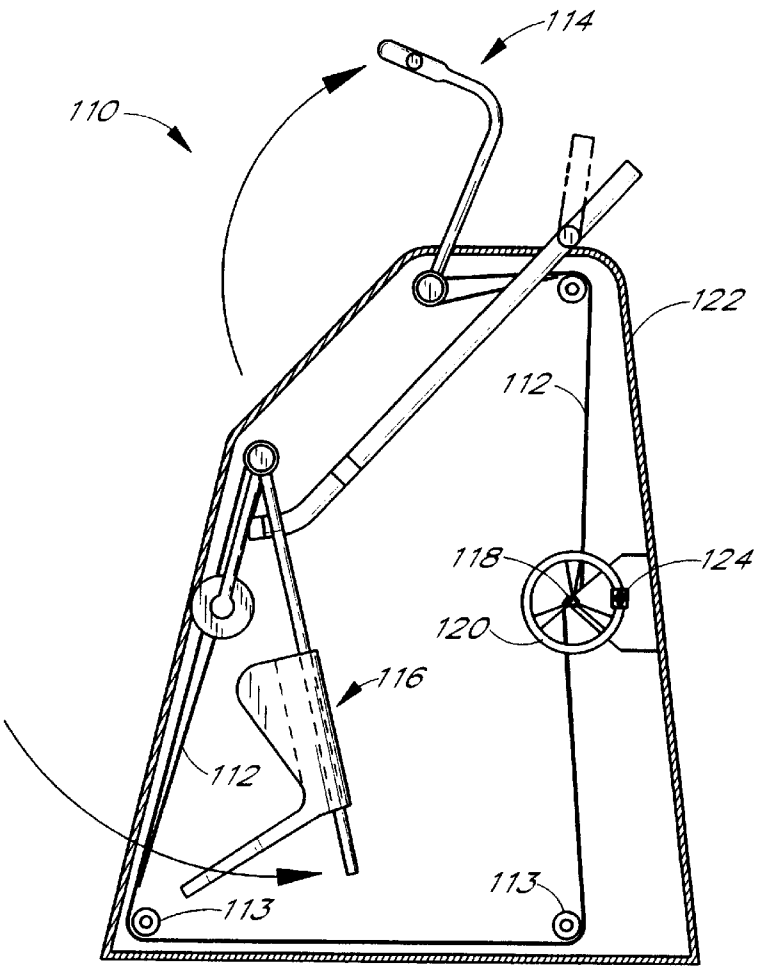
FIG. 8 is a side elevational view of an exercise machine illustrating a cable and pulley mechanism for coupling the rotation of the arm and leg lever on one side of the machine, and including a coupled flywheel and associated braking system.

FIG. 8 illustrates an exercise machine 110 similar to that shown in FIG. 7, with a pair of cables 112, or a continuous cable, and an assembly of pulleys 113 coupling the rotation of an arm lever 114 and a leg lever 116. The cable 112 loops around the shaft 118 of a flywheel 120 mounted for rotation in a frame 122, or attaches to a moment arm extending outward from the shaft to apply torque to the shaft. An adjustable friction applicator 124 is mounted to apply friction to the wheel 120. The amount of friction applied to the wheel 120 increases the tension in the cable 112 and increases the torque resistance to rotational movement of the arm and leg levers 114 and 116. Again, the arm and leg levers 114 and 116 are mounted for rotation in the frame 122 about axes which approximate the user's shoulder and hip joints, respectively.

Figure 9:
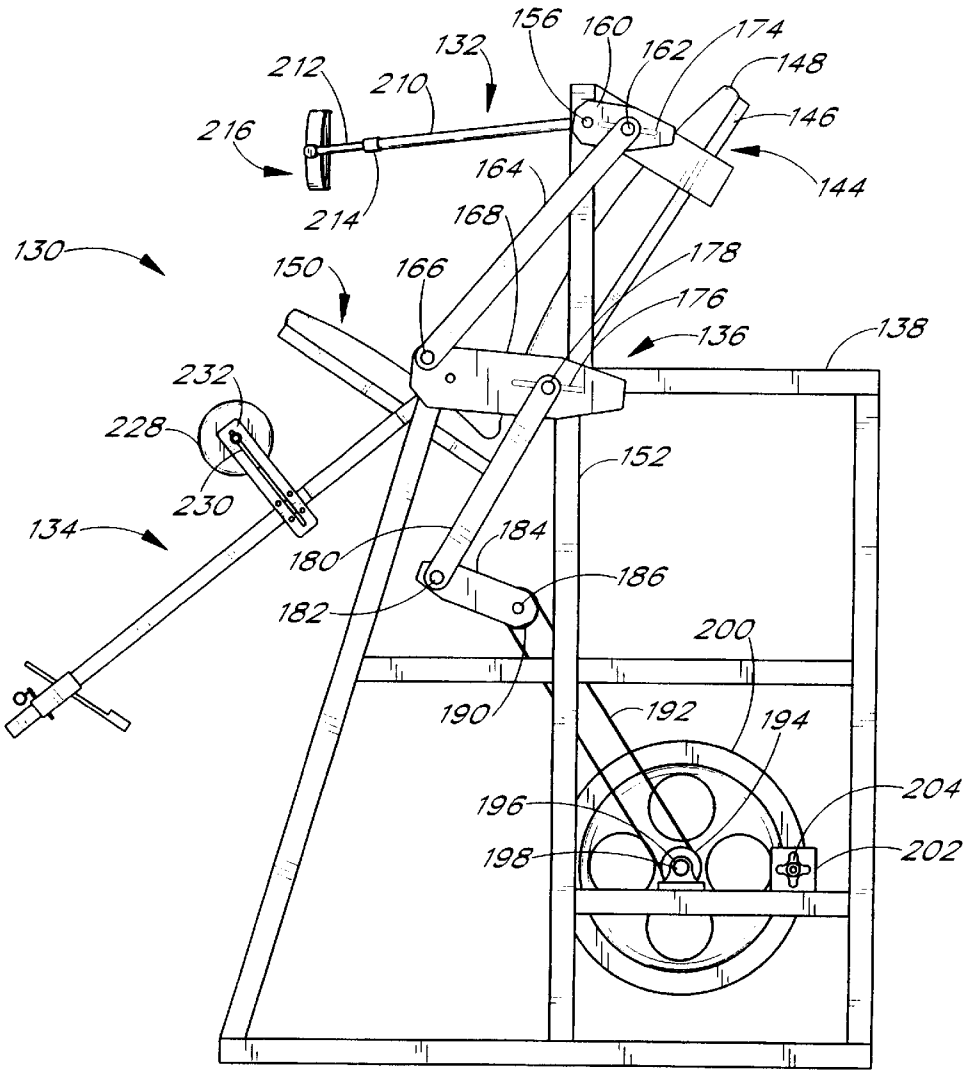
FIG. 9 is a side elevational view of a preferred embodiment of the exercise machine of the present invention showing the arm and leg levers coupled for rotation via a mechanical linkage mechanism, and a coupled flywheel and associated braking system.
Figure 10:
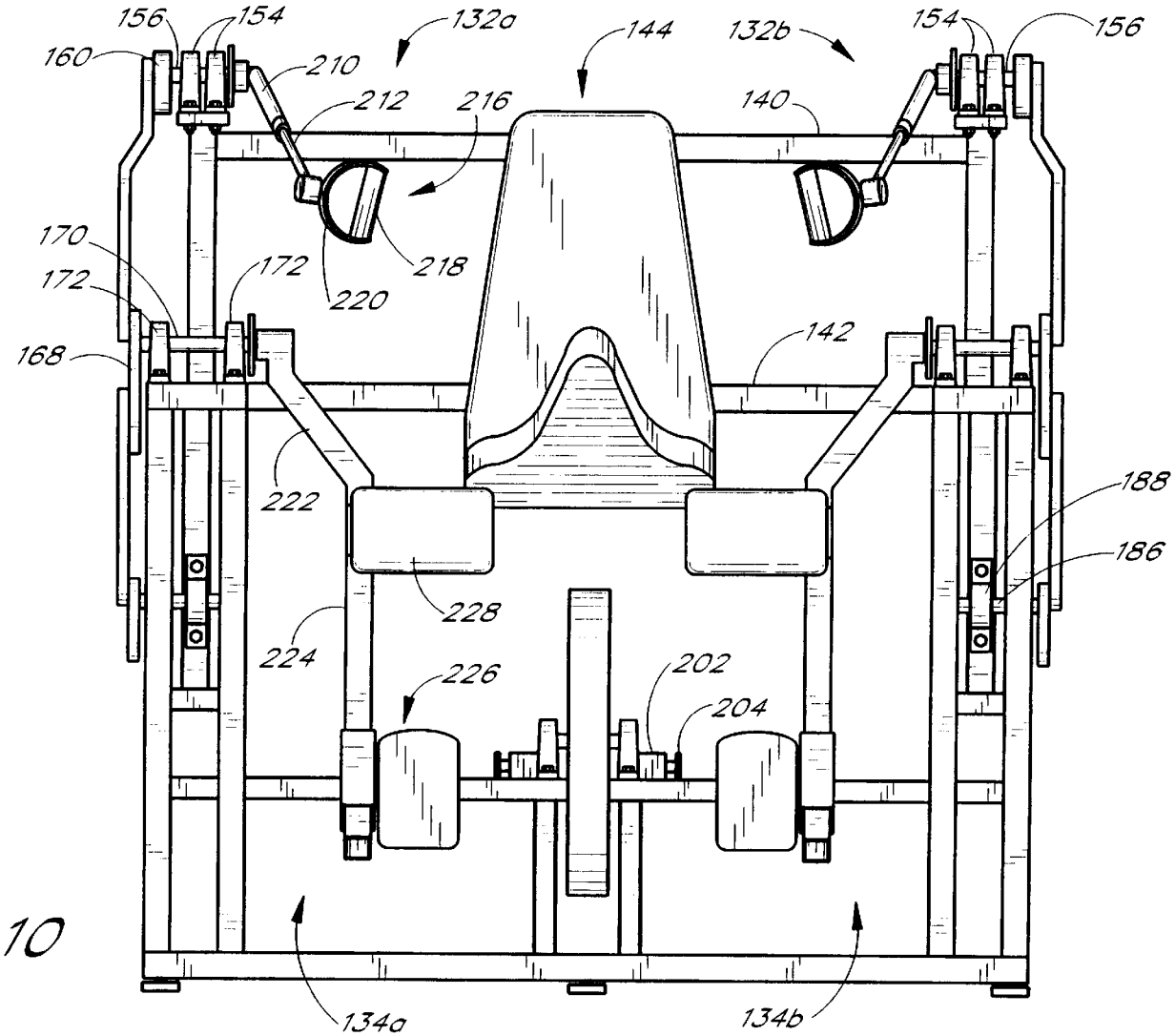
FIG. 10 is a front elevational view of the exercise machine of FIG. 9.

FIG. 9 illustrates an exercise machine 130 constructed in accordance with the present invention in which an arm lever 132 and a leg lever 134 on each side are coupled for synchronous rotation via a mechanical linkage mechanism 136. FIG. 10 illustrates the exercise machine 130 in frontal view and shows a right arm lever 132*a* and a left arm lever 132*b* in a lowered position, and a right leg lever 134*a* and left leg lever 134*b* also in lowered positions. Again, although the rotations of the arm and leg levers 132 and 134 on each side are coupled, and out of phase with the opposite side, other arrangements are possible. The following description references only one side of the exercise machine, with the same description applicable to both sides.

The exercise machine 130 includes a rigid frame 138 on which the various human support and rotating components are mounted. The frame may comprise a plurality of exposed beams as shown, or may be enclosed within a unitary housing to protect the user from any moving components or lubrication. In a preferred embodiment the frame 138 is constructed of a lightweight material such as aluminum or composite. FIG. 10 illustrates an upper cross piece 140, and a middle cross piece 142 on which a bench 144 designed to the support the weight of the user is mounted. As was described previously, the bench 144 preferably comprises a rigid backboard 146 and a padded, vinyl covered cushion 148. The bench 144 is mounted in the center of the machine 130 between the arm and leg levers 132 and 134 at an angle to the horizontal and further includes a seat portion 150 extending perpendicularly from the backboard 146.

The frame 138 includes a middle vertical column 152 on either side of the bench 144 having a top end supporting a pair of bearing members 154. Each pair of bearings 154 provides a mount for a short shaft to rotate within along a horizontal axis. Each shaft 156 is rigidly attached to and rotates with an arm lever 132. The outer end of the shaft 156 is rigidly coupled to and rotates with an arm crank 160. The arm crank 160, in turn, includes a bearing member 162 aligned in a horizontal axis about which a first linkage bar 164 rotates. The linkage bar 164 extends downward at an angle to rotate about a bearing member 166 provided in a leg crank 168. The leg crank 168 is rigidly attached to a second shaft 170 mounted for rotation within a pair of bearing members 172 fixed to the frame 138. The bearing member 162 is spaced from the axis of rotation of the first shaft 156 so that the upper end of the first linkage bar 164 rotates about the axis of the first shaft. Simultaneously, the bearing member 166 is spaced from the axis of rotation of the second shaft 170 so that the lower end of the first linkage bar 164 rotates about the axis of the second shaft.

An inner end of the second shaft 170 is rigidly coupled to and rotates with the leg lever 134. As can be readily seen, the first linkage bar 164 couples the rotation of the arm lever 132 and leg lever 134. The distance between the axes of the first shaft 156 and bearing member 162 in relation to the distance between the axes of the second shaft 170 and the bearing member 166 affects the relative angular speed of rotation of the arm and leg levers 132 and 134. One of skill in the art will recognize that various ratios of angular rotation may be provided by adjusting the distance between the centers of these axes of rotation. Indeed, an elongated slot 174 may be formed in the arm crank 160 and allows for adjustment of the distance between the centers of the bearing member 162 and the first shaft 156, although the bearing member 162 will likely be positioned within a fixed hole in the arm crank 160 for simplicity.

Rotation of the arm lever 132 and leg lever 134 provides rotation to both the arm crank 160 and the leg crank 168. The second shaft 170 is attached to the leg crank 168 so that a large portion of the second crank rotates along an arc therearound. A longitudinal slot 176 may be formed in an end of the arm crank 168 opposite the second shaft 170 and provides a mounting location for a bearing member 178 (although in the preferred form the bearing member 178 mounts at a fixed location on the arm crank 168 for simplicity). A second linkage bar 180 rotates at a top end about the bearing member 178 and at a bottom end about another bearing member 182 fixed in one end of a connecting bar 184. The connecting bar 184 is rigidly fastened to and rotates with a shaft 186. The shaft 186, in turn, rotates about a fixed bearing 188 in the frame 138 and continues inward to an upper toothed gear or sprocket 190 keyed to rotate therewith.

The upper sprocket 190 drives a chain or toothed belt 192 which extends around a lower toothed gear or sprocket 194 mounted for rotation about a bearing member 196 fixed in the frame 138. A shaft 198 on which the lower sprocket 194 is keyed to rotate also supports a large flywheel 200 disposed in a lower part of the frame 138. It will thus be apparent that rotation of the flywheel 200 is initiated by reciprocating motion of the arm and leg levers 132, 134 through the linkage mechanisms 136 on either side. Additionally, the flywheel shaft 198 couples the motion of the right and left linkage mechanisms and synchronizes the rotation of the right and left arm and leg levers. More detail on the motion of each of the elements in the linkage mechanism 136 will be given below with respect to FIGS. 11 and 12.

The rotation of the flywheel 200 is resisted by a braking mechanism 202 mounted to the frame 138. The braking mechanism 202 may, as illustrated, comprise a simple threaded tightening mechanism 204 on either side of the flywheel 200 to apply compressive force thereto. In a preferred form, the braking mechanism 202 comprises an electromagnetic brake having a rotor driven by the flywheel, the electromagnetic brake applying a drag to the flywheel based on a variable current supplied thereto. Such mechanisms are well know in the art.

With reference again to FIGS. 9 and 10, the arm lever 132 comprises a telescopically arranged proximal tubular element 210 and distal tubular element 212. Each arm lever 132 extends at a slight inward angle from its respective bearings 154 to provide clearance for the user in the shoulder region. A small locking sleeve 214 is provided to fix the relative linear positions of the proximal and distal elements 210 and 212. Such a sleeve 214 may be, for example, a threaded sleeve for tightening a bifurcated inner collar. In any event, the distance between the axis of the first shaft 156 and a hand grip 216 may be adjusted and fixed using the telescoping arrangement of the arm lever 132. The hand grip 216 comprises a handle 218 held within an arcuate bracket 220 which is mounted on a distal end of the distal element 212. The bracket 220 preferably includes a slot through which a threaded fastener extends to attach the bracket to the arm lever 132; the slot providing for some adjustment for the angular orientation of the handle 218. Additionally, the handle 218 may be rotated about the fastener axis. These adjustments allow for customizing of the position of the hand grip 216 based on the needs of a particular user of the exercise machine 130.

The leg lever 134, as seen in FIG. 10, extends along an angular region 222 inward from its point of attachment to the second shaft 170 and terminates in a straight portion 224 extending downward to an adjustable foot rest 226. As mentioned previously, the foot rest 226 can be slid longitudinally along the straight portion of 224 and fastened in various locations to accommodate various user leg sizes. Additionally, a knee rest 228 is provided on the leg lever 134 and is mounted via an elongated slot 230 in fastener 232, as seen in FIG. 9. The knee rest must be adjusted toward or away from the straight portion 224 of the leg lever 134 for different bent postures of the user's leg. That is, if the user desires a straighter leg posture, the knee rest 228 is adjusted to be closer to the leg lever 134.

FIGS. 11*a–d* illustrate a first mode of operation of the exercise machine 138 in which the flywheel 200 rotates in a clockwise direction as viewed from the left side of the machine. The orientation of the components within the linkage mechanism 135 will be described with respect to the rotational position of the connecting bar 184. That is, the connecting bar 184 is rigidly fixed to rotate at the same angular speed as the flywheel 200, due to the positive coupling of the sprockets 190, 194 and belt 192. In this scenario, the upper and lower sprockets 190 and 194 are of equal diameter, but other gearing arrangements are possible.

Figure 11B:
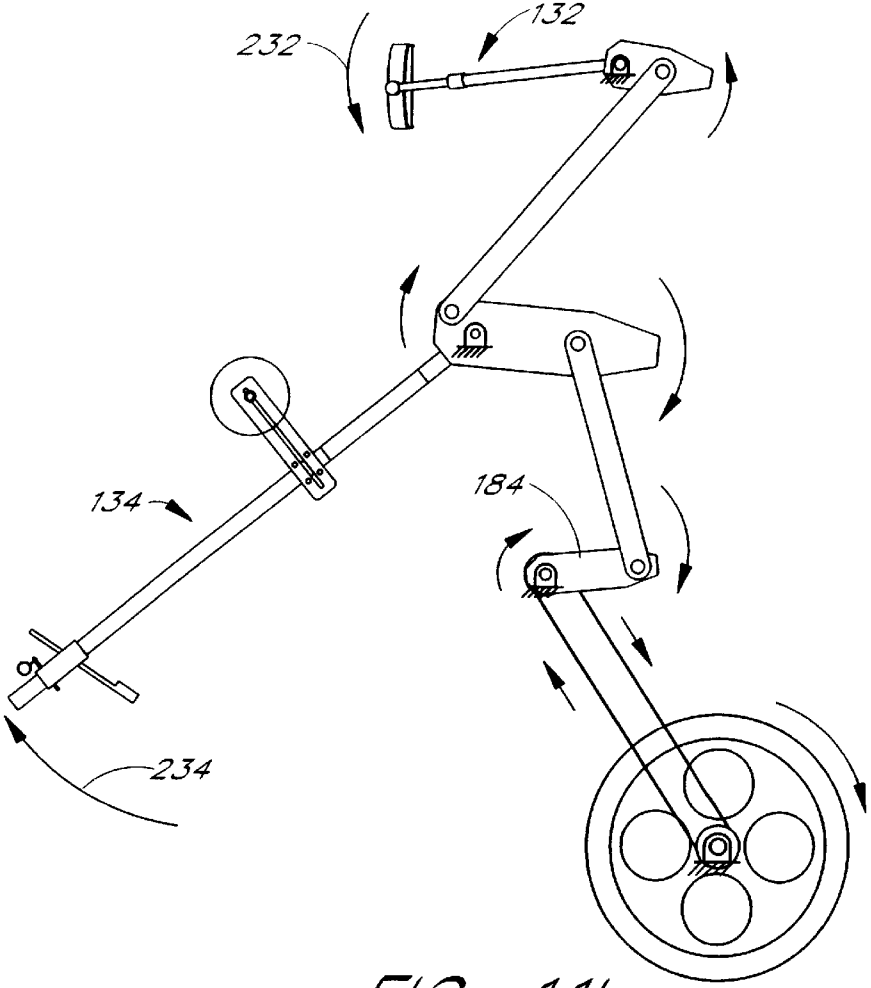
FIGS. 11*a–d* are schematic side views of the exercise machine of FIG. 9 showing various rotational positions of the arm and leg levers and associated linkage mechanism.
Figure 11A:
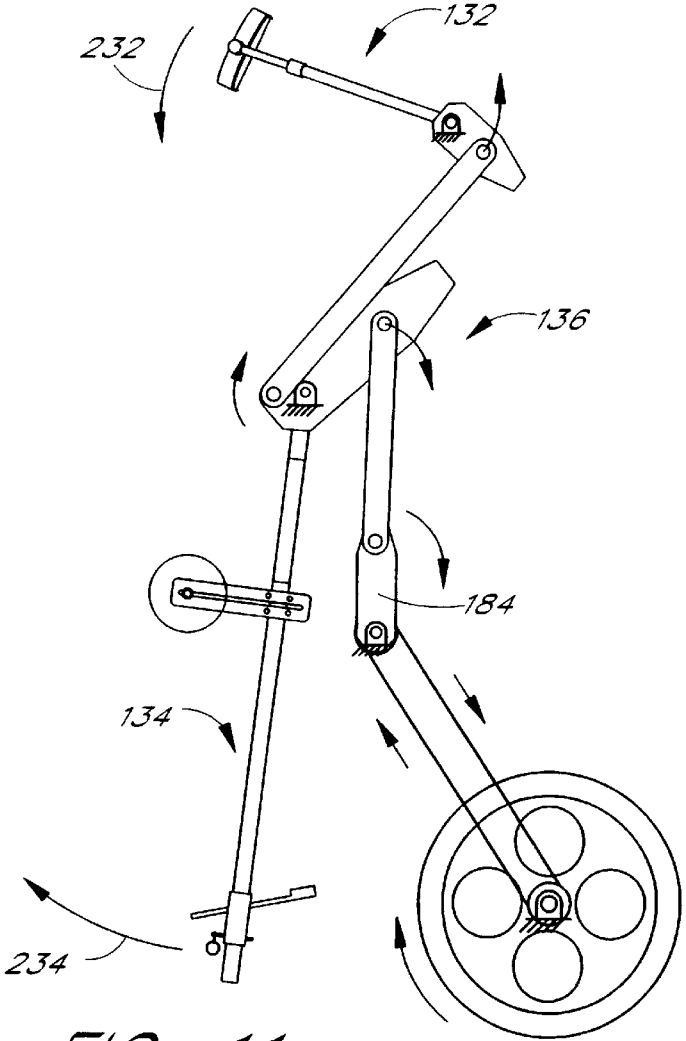

FIG. 11*a* thus shows the connecting bar 184 in a clockwise rotation at a slight angle from straight up, or top dead center (TDC), of approximately 5°. The TDC position of the linkage mechanism 136 in FIG. 11*b* corresponds to a position of maximum travel of both the arm lever 132 and leg lever 134. That is, the arm lever 132 has reached its highest point and has begun a downward swing as indicated by the arrow 232. Likewise, the leg lever 134 has reached its lowermost position and has begun an upward swing as indicated by the arrow 234. Rotation of the connecting bar 184 causes rotation of the upper sprocket 190, belt 192 and lower sprocket 194 so that the flywheel 200 rotates in a clockwise direction as well.

FIG. 11*b* illustrates the connecting bar 184 in a position approximately 45° from TDC and rotating in a clockwise direction. The arm lever 132 continues its downward swing and the leg lever 134 continues upward.

Figure 11D:
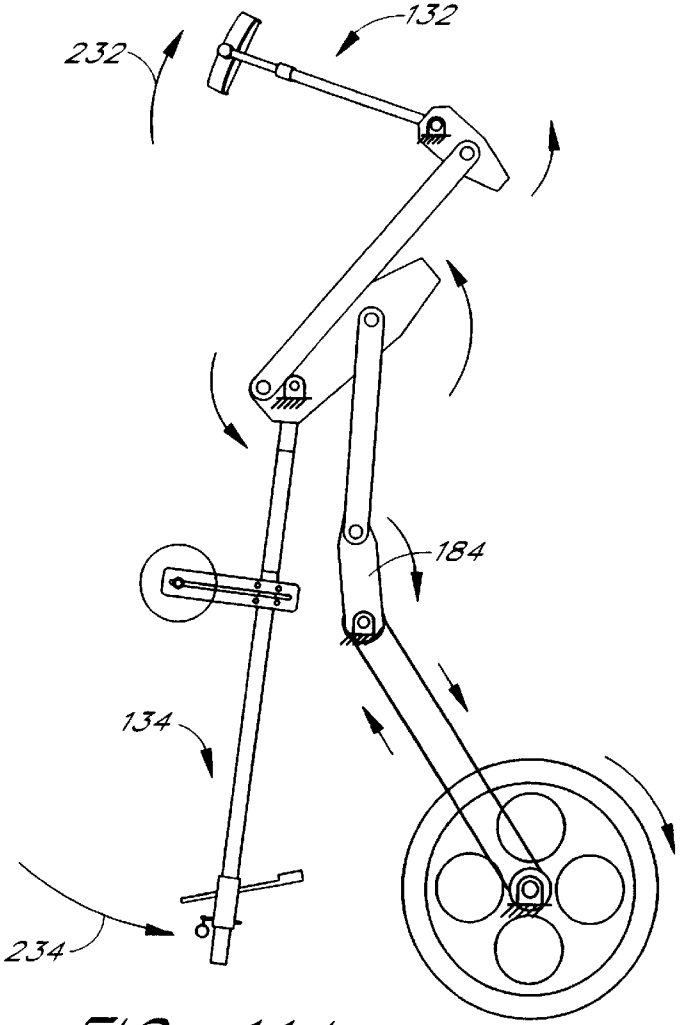
Figure 11C:
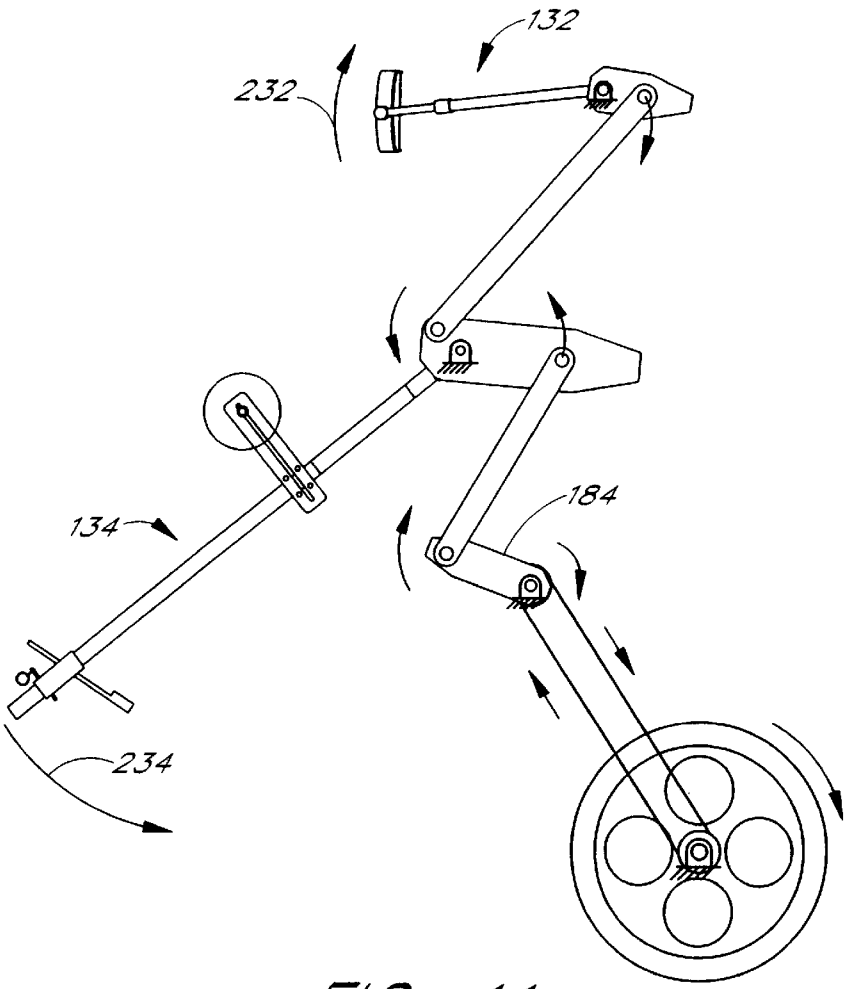

FIG. 11*c* illustrates the connecting bar 184 in a position approximately 270° from TDC and rotating in a clockwise direction. The arm lever 132 has reached a lower most position (at the point at which the connecting bar 184 reached bottom dead center (BDC)) and has commenced an upward swing. Likewise, the leg lever 134 has reached an uppermost position and has commenced a downward swing.

Finally, FIG. 11*d* shows the connecting bar 184 still in a clockwise rotation at a slight angle of approximately −5° from TDC. The arm lever 132 is nearing its highest point but continues to swing upward, and the leg lever 134 is nearing its lowermost position and continues to swing downward.

The rotational direction of the flywheel 200 may be reversed by changing direction of the swings of the arm and leg levers at any point other than the TDC and BDC positions of the connecting bar 184. Furthermore, the flywheel 200 presents a substantial inertia to initial rotation, but as suggested by its name, allows the user to intermittently "coast" along with little effort while still maintaining movement of the arm and leg levers.

Although this invention has been described in terms of certain preferred embodiments, other embodiments that will be apparent to those of ordinary skill in the art are intended to be within the scope of this invention. For example, the specific dynamic characteristics of the torsional resistance applied to the arm and leg levers may be constant, linearly increasing with increased swing of the levers, or nonlinear, such as with a viscous damping system. Accordingly, the scope of the invention is intended to be defined by the claims that follow.

What is claimed is:

1. An exercise machine for an isometric work out of the arms and legs of the user while minimizing stress on the elbows and knee joints, comprising:

a rigid frame;

a bench seat comprising a back support defining an upper back support surface and a seat portion defining a seating surface, the bench seat being mounted to the frame and adapted to support the weight of a user, the back support being inclined with respect to a horizontal plane;

a pair of arm levers mounted for reciprocal pivoting motion in the frame about a first common horizontal axis which is spaced above the upper back support surface and is adjustable so as to allow the first axis to be approximately aligned with a shoulder joint of an average user positioned on the bench seat;

a torque resistance system coupled to the pivoting motion of the arm levers to provide torque resistance to rotation of the arm levers, the user pivoting the arm levers about the axis of rotation without substantially flexing or contracting the elbow joint, thus exercising the arms isometrically;

a pair of leg levers mounted for reciprocal pivoting motion in the frame about a second common horizontal axis, the second axis being spaced above the seating surface and being adjustable so as to allow the first axis to be approximately aligned with a hip joint of an average user positioned on the bench seat; and a torque resistance system coupled to the pivoting motion of the leg levers to provide torque resistance to rotation of the leg levers, the user pivoting the leg levers about the axis of rotation without substantially flexing or contracting the knee joint, thus exercising the legs isometrically.

2. An exercise machine for an isometric work out of the legs of the user, comprising:

a rigid frame;

a bench seat comprising a back support defining an upper back support surface and a seat portion defining a seating surface, the bench seat being mounted to the frame and adapted to support the weight of a user, the back support being inclined with respect to a horizontal plane;

a pair of leg levers mounted for reciprocal pivoting motion in the frame about a first common horizontal axis, the first axis being spaced above the seating surface and being adjustable so as to allow the first axis to be approximately aligned with a hip joint of an average user positioned on the bench seat; and a torque resistance system coupled to the pivoting motion of the leg levers to provide torque resistance to rotation of the leg levers, the user pivoting the leg levers about the axis of rotation without substantially flexing or contracting the knee joint, thus exercising the legs isometrically.

3. The exercise machine of claim 2 further comprising:

a pair of arm levers mounted for reciprocal pivoting motion in the frame about a second common horizontal axis approximately aligned with a shoulder joint of an average user positioned on the bench seat; and a torque resistance system coupled to the pivoting motion of the arm levers to provide torque resistance to rotation of the arm levers, the user pivoting the arm levers about the axis of rotation without substantially flexing or contracting the elbow joint, thus exercising the arms isometrically.

4. The exercise machine of claim 3, wherein the rotation of an arm lever on a left side of the machine is coupled to the rotation of a leg lever on the left side of the machine.

5. The exercise machine of claim 4, wherein the rotation of the arm levers on the left and right sides of the machine are coupled.

6. The exercise machine of claim 5, wherein the rotation of the arm levers on the left and right sides of the machine are in phase so that they rotate in tandem.

7. The exercise machine of claim 2, further comprising:

a coil spring fastened to the frame and fastened to a portion of the leg lever to apply a torsional spring force to rotation of the leg lever.

8. The exercise machine of claim 2, further comprising:

a system of pulleys mounted to the frame;

a cable extending from the leg lever around the pulleys; and a dead weight attached to the cable, the system of pulleys being configured to guide the cables such that the dead weight is lifted upon rotation of the leg lever to apply a torsional resistance thereto.

9. The exercise machine of claim 2, further comprising:

a flywheel mounted for rotation on the frame;

a connecting member mounted on the frame to rotate with the flywheel; and a linkage mechanism mounted on the frame for converting the reciprocal pivoting motion of the leg levers to the rotational motion of the connecting member to rotate the flywheel.

10. The exercise machine of claim 9, further comprising:

a means for applying a torsional resistance to rotation of the flywheel, thus applying a torsional resistance to the reciprocal pivoting motion of the leg levers.

11. The exercise machine of claim 10, wherein said torsional resistance means comprises a friction brake.

12. An exercise machine for an isometric work out of the arms of the user, comprising:

a rigid frame;

a bench seat comprising a back support defining an upper back support surface and a seat portion defining a seating surface, the bench seat being mounted to the frame and adapted to support the weight of a user, the back support being inclined with respect to a first horizontal plane;

a pair of arm levers mounted for reciprocal pivoting motion in the frame about a first common horizontal axis, the first axis being spaced above the upper back support surface and being adjustable so as to allow the first axis to be approximately aligned with a shoulder joint of the average user positioned on the bench seat; and a torque resistance system coupled to the pivoting motion of the arm levers to provide torque resistance to rotation of the arm levers, the user pivoting the arm levers about the axis of rotation without substantially flexing or contracting the elbow joint, thus exercising the arms isometrically.

13. The exercise machine of claim 12, further comprising:

a pair of leg levers mounted for reciprocal pivoting motion in the frame about a second common horizontal axis approximately aligned with a hip joint of the average user positioned on the bench seat; and a torque resistance system coupled to the pivoting motion of the leg levers to provide torque resistance to rotation of the leg levers.

14. The exercise machine of claim 13, wherein the rotation an arm lever on the left side of the machine is coupled to the rotation of a leg lever on the right side of the machine.

15. The exercise machine of claim 13, wherein the arm levers and the leg levers of the machine are in phase so that they rotate in tandem.

16. The exercise machine of claim 1, wherein the rotation an arm lever on the left side of the machine is coupled to the rotation of a leg lever on the right side of the machine.

17. The exercise machine of claim 1, wherein the arm levers and the leg levers of the machine are in phase so that they rotate in tandem.

* * * * *